US007700871B2

(12) United States Patent
Bertini et al.

(10) Patent No.: US 7,700,871 B2
(45) Date of Patent: Apr. 20, 2010

(54) ACID-CATALYZED DIELECTRIC ENHANCEMENT FLUID AND CABLE RESTORATION METHOD EMPLOYING SAME

(75) Inventors: Glen J. Bertini, Tacoma, WA (US); Gary A. Vincent, Auburn, WA (US)

(73) Assignee: Novinium, Inc., Kent, WA (US)

( * ) Notice: Subject to any disclaimer, the term of this patent is extended or adjusted under 35 U.S.C. 154(b) by 446 days.

(21) Appl. No.: 11/625,251

(22) Filed: Jan. 19, 2007

(65) Prior Publication Data

US 2008/0173467 A1 Jul. 24, 2008

(51) Int. Cl.
*H01B 3/00* (2006.01)

(52) U.S. Cl. ..... 174/25 C; 427/117; 427/118; 427/140

(58) Field of Classification Search ..... 174/25 C; 427/117, 118, 140; 156/48
See application file for complete search history.

(56) References Cited

U.S. PATENT DOCUMENTS 3,800,017 A 3/1974 Williams et al.
3,956,420 A 5/1976 Kato et al.
4,088,666 A * 5/1978 Langer et al. ..... 546/344
4,144,202 A 3/1979 Ashcraft et al.
4,212,756 A 7/1980 Ashcraft et al.
4,297,310 A * 10/1981 Akutsu et al. ..... 264/83
4,299,713 A 11/1981 Maringer et al.
4,332,957 A 6/1982 Braus et al.
4,372,988 A 2/1983 Bahder
4,400,429 A 8/1983 Barlow
4,545,133 A 10/1985 Fryszczyn et al.
4,608,306 A 8/1986 Vincent
4,766,011 A * 8/1988 Vincent et al. ..... 427/117
4,840,983 A 6/1989 Vincent
4,870,121 A 9/1989 Bamji et al.
5,198,518 A * 3/1993 Yamamoto et al. ..... 528/12
5,200,234 A * 4/1993 Bertini ..... 427/118
5,279,147 A 1/1994 Bertini et al.
5,372,840 A 12/1994 Kleyer et al.
5,372,841 A 12/1994 Kleyer et al.
5,907,128 A 5/1999 Lanan et al.
6,005,055 A 12/1999 Dammert et al.
6,162,491 A 12/2000 Bertini et al.
6,274,277 B1 * 8/2001 Mori et al. ..... 429/307
6,697,712 B1 2/2004 Bertini et al.
7,195,504 B2 3/2007 Bertini et al.
7,353,601 B1 4/2008 Bertini et al.

(Continued)

OTHER PUBLICATIONS

U.S. Appl. No. 11/379,979, filed Apr. 24, 2006, Bertini.

(Continued)

*Primary Examiner*—Kat Wyrozebski
*Assistant Examiner*—Daniel Lee
(74) *Attorney, Agent, or Firm*—Davis Wright Tremaine LLP; George C. Rondeau, Jr.

(57) ABSTRACT

A dielectric enhancement fluid composition having at least one organoalkoxysilane and an acid catalyst having a $pK_A$ less than about 2.1 and a method for using the composition to enhance the dielectric properties of an electrical cable having a central stranded conductor encased in a polymeric insulation and having an interstitial void volume in the region of the conductor, the method comprising at least partially filling the interstitial void volume of the cable with the composition. The fluid composition may further include an organometallic catalyst and a corrosion inhibitor.

22 Claims, 9 Drawing Sheets

U.S. PATENT DOCUMENTS

| | | | | |
|---|---|---|---|---|
| 2002/0046865 | A1 | 4/2002 | Bertini et al. | |
| 2002/0132908 | A1 | 9/2002 | Yagihashi et al. | |
| 2004/0132888 | A1 | 7/2004 | Naiki et al. | |
| 2005/0189130 | A1 * | 9/2005 | Bertini et al. | 174/25 C |
| 2005/0191910 | A1 | 9/2005 | Bertini et al. | |
| 2005/0192708 | A1 | 9/2005 | Bertini | |
| 2006/0215079 | A1 | 9/2006 | Suzuki et al. | |

OTHER PUBLICATIONS

U.S. Appl. No. 11/468,274, filed Aug. 29, 2006, Bertini et al.
Glen J. Bertini, UTILX Corp.; Recent Advancements in Cable Rejuvenation Technology; IEEE/PES 1999 Summer Meeting; Reliability Centered Maintenance, Jul. 21, 1999; 5 pgs.
C. Katz, B. Fryszcynm, M. Walker B.S. Bernstein; Extending the Service Life of Ethylene Propylene Rubber Insulated Cables; IEEE Paper presented at ICC mtg; 1999-2000; 6 pgs.
Kim Jenkins UTILX Corp. Submarine Cable Rescued With Silicone-Based Fluid; Slide Presentation; USA 18 pgs.
Premedia Businss Magazines & Media Inc; Submarine Cable Rescued With Silicone-Based Fluid; Transmission & Distribution World; Jul. 1, 1999; 4 pgs; USA.
Glen J. Bertini, IEEE UTILX Corp; Enhancing the Reliability of Solid-dielectric Cable; 4 pgs; Kent, Washington; USA.
R. Hudson & M. Crucitt; Salt River Project; SRP Enhance Reliability of Underground Distribution Cable; 4 pgs; http://www.tdworld.com/mag/power_srp_enhances_reliability/ .
IEEE Power Engineering Society; Insulated Conductors Committee Meeting, Minutes of the 104th Meeting; Oct. 25-26, 1998; GB600565-GB600568; St. Petersburg, FLA USA.
EPRI Secondary Cable Workshop; Extending the Life of Secondary Cables; May 6, 1998; 1 page; Charlotte, NC USA.
East Grand Forks Case Study; 1997; 1 page USA.
IEEE Power Engineering Society; The Importance of Diffusion and Water Scavenging in Dielectric Enhancement; Technical Paper Summaries; 7 pages.
Glen J. Bertini, Entergy Metro Case Study: Post-Treatment Lessons; ICC Meeting; Apr. 1997; Scottsdale, Arizona; USA.
Glen J. Bertini, Dow-Corning Corp, Cliff Richardson, Hendrix Wire & Cable; Silicone Strand-Fill: A New Method and Process; Spring 1990 IEEE/PES ICC; 11 pgs; Dearborn, MI.
A.L. McKean; Breakdown Mechanism Studies in Crosslinked Polyethylene Cable; IEEE Transactions on Power Apparatus and Systems, vol. PAS-95, No. 1; Jan./Feb. 1976; Yonkers, NY; USA.
Bertini and Vincent; ICC Subcommittee A; "Cable Rejuvenation Mechanisms"; Mar. 14, 2006.
Robert E. Treybal; Mass-Transfer Operations, Chapter 4 "Diffusion in Solids" pp. 88-103; McGraw-Hill Book Company; 1980.

* cited by examiner

ACID-CATALYZED DIELECTRIC ENHANCEMENT FLUID AND CABLE RESTORATION METHOD EMPLOYING SAME

FIELD OF THE INVENTION

The present invention relates to a method for restoring the dielectric properties of an electrical cable comprising injecting a catalyzed dielectric enhancement fluid composition into the cable's interior.

BACKGROUND OF THE INVENTION

Restoration of the dielectric properties of in-service electrical power cables is well known. The general method comprises injecting a dielectric enhancement fluid into the interstitial void space associated with the conductor geometry of the cable. Typically, the injected fluid is an organoalkoxysilane monomer which subsequently diffuses radially outward through the polymeric insulation jacket to fill the deleterious micro-voids ("trees") which form therein as a result of exposure to high electric fields and/or adventitious water. The organoalkoxysilane can oligomerize within the insulation, the shields, and the interstitial void volume of the cable by first reacting with adventitious water. In the case of in-service cables, as defined below, water can be present in the conductor strands as well as the intermolecular spaces of the polymeric components and fillers associated therewith (e.g., carbon black for most conductor and insulation shields; clay for most rubber insulation formulations). Water can also reside in micro-voids formed during manufacture of the cable and those formed during aging (e.g. water trees and halo). Furthermore, water can also diffuse into the cable from the environment. Oligomerization of the organoalkoxysilane retards the exudation of fluid from the insulation and micro-voids of the cable. An early method of this type, wherein the dielectric enhancement fluid was an aromatic alkoxysilane, was described by Vincent et al. in U.S. Pat. No. 4,766,011. This disclosure teaches the optional inclusion of a "hydrolysis condensation catalyst" as a part of the treatment fluid formulation to promote the above-mentioned oligomerization. A variation of the '011 patent method, which employs a mixture of an antitreeing agent, such as an organoalkoxysilane, and a rapidly diffusing water-reactive component as the dielectric enhancement fluid, also teaches the inclusion of such a catalyst, albeit with less emphasis. This method has enjoyed commercial success for more than a decade (see U.S. Pat. No. 5,372,841).

However, even though the above patent references recognized the benefit of including a catalyst and the importance of preventing the exudation of the dielectric property-enhancing fluid from the cable, they only disclose the use of certain organometallic catalysts.

SUMMARY OF THE INVENTION

There is disclosed a method for enhancing the dielectric properties of an electrical cable having a central stranded conductor encased in a polymeric insulation jacket and having an interstitial void volume in the region of the conductor, the method comprising introducing a dielectric enhancement fluid composition into the interstitial void volume, the composition comprising (a) at least one organoalkoxysilane; and (b) an acid catalyst having a $pK_A$ less than about 2.1.

Further, the above cable restoration method can be practiced by injecting the composition into the cable at an elevated pressure and confining it in the interstitial void volume of the cable at a residual elevated pressure.

DETAILED DESCRIPTION OF THE INVENTION

Figure 1:
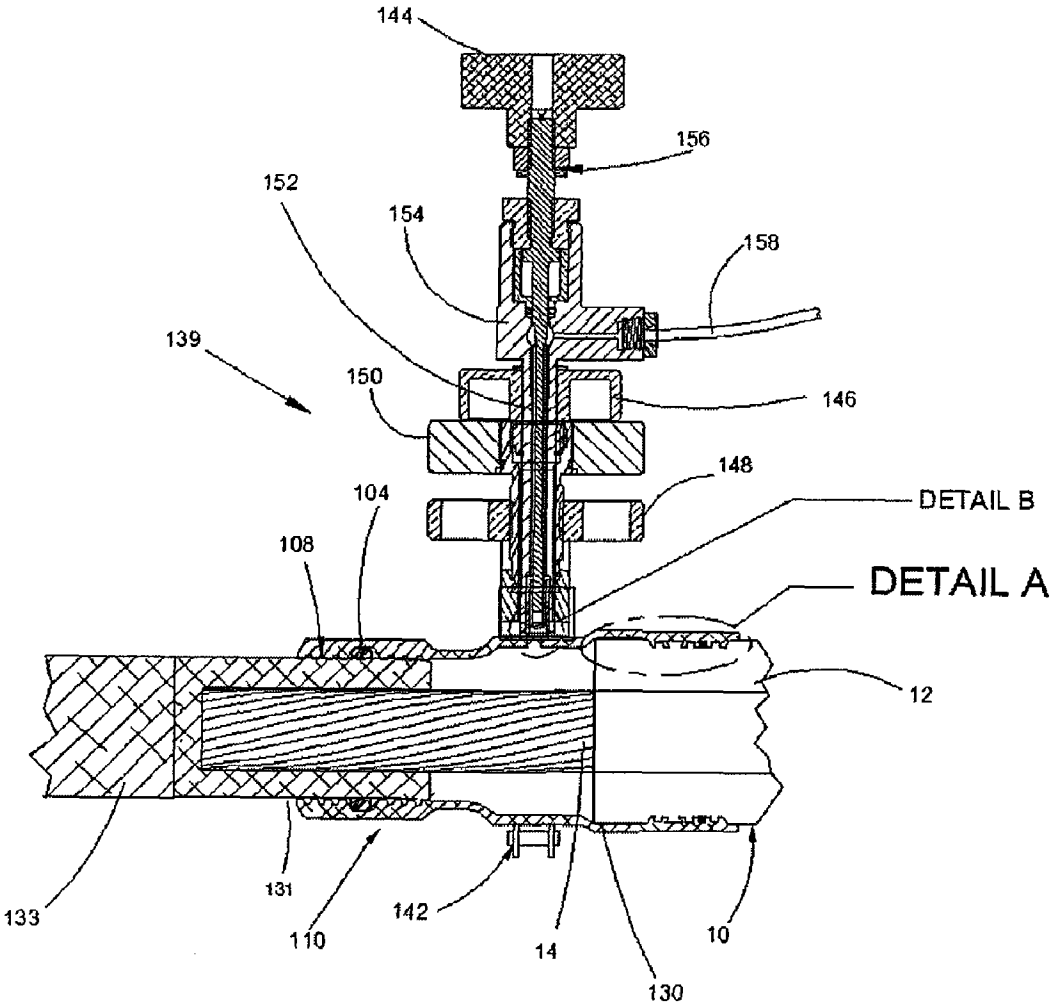
FIG. 1 shows a cross-sectional view of an injection tool clamped in position over a swagable high-pressure terminal connector having a trapezoidal recessed groove.

Those skilled in the art will recognize that, in order to get the full benefit from an organoalkoxysilane dielectric enhancement fluid in the above described restorative method, the fluid should be supplied to, and retained within, the insulation jacket. If even a portion of this fluid diffuses completely through the insulation and prematurely exudes from the cable segment, the inevitable result will be poorer alternating current (AC) breakdown performance and a shorter post-treatment life for the cable than would be realized had the fluid been retained in the insulation. As mentioned above, this was addressed in the prior art by including a catalyst to promote reaction of an organoalkoxysilane with adventitious water in the cable followed by condensation of the resulting hydrolyzate, thereby oligomerizing the organoalkoxysilane such that its further diffusion through the insulation was retarded. It has now been discovered that a greater portion of an organoalkoxysilane injected into a cable according to the above described method can be retained within the cable insulation to provide an even more effective restoration thereof by inclusion of a particular class of acid catalyst in the injected composition.

Thus, in one embodiment, there is disclosed a method for enhancing the dielectric properties of an electrical cable having a central stranded conductor encased in a polymeric insulation and having an interstitial void volume in the region of the conductor, the method comprising at least partially filling the interstitial void volume with a dielectric enhancement fluid composition, also referred to herein as a dielectric property-enhancing fluid composition, comprising (a) an organoalkoxysilane; and (b) an acid catalyst having a $pK_A$ less than about 2.1.

As used herein, the term "in-service" refers to a cable which has been under electrical load and exposed to the elements, usually for an extended period (e.g., 10 to 40 years). In such a cable, the electrical integrity of the cable insulation has generally deteriorated to some extent due to the formation of water or electrical trees, as well known in the art. Further, the term cable "segment," as used herein, refers to the span of cable between two terminal connectors, while a cable "sub-segment" is defined as a physical length of uninterrupted (i.e., uncut) cable extending between the two ends thereof. Thus, a cable segment is identical with a sub-segment when no splices are present between two connectors. Otherwise, a sub-segment can exist between a terminal connector and a splice connector or between two splice connectors, and a cable segment can comprise one or more sub-segments. For the sake of efficiency herein, the general term "cable" will be used herein to designate either a cable segment or a cable sub-segment.

In general, the organoalkoxysilane (a) contemplated herein (also referred to as a tree retardant agent or anti-treeing agent) may be selected from those known in the art to prevent water trees in polymeric insulation when compounded into the insulation material and/or injected into a new or an in-service cable. A generic example of such an organoalkoxysilane may be represented by the formula:

$$(RO)_x SiR'_y R''_z R'''_{(4-x-y-z)} \quad (1)$$

where R denotes an alkyl group having 1 to 12 carbon atoms but preferably 1 to 2 carbon atoms, and R', R", and R'" independently denote aliphatic, unsaturated aliphatic or aromatic groups having up to 12 carbon atoms. The subscript x is an integer having a value of 1 to 3, and subscripts y and z are independent integers each having a value of 0 to 3. Preferably, R is a methyl group, x is 2 or 3 and at least one other substituent on the silicon atom (i.e., either R', R" or R'" is an aromatic group or an unsaturated aliphatic, the latter preferably having 2 to 3 carbon atoms). Furthermore, any or all of the R', R" and R'" groups may be independently substituted with halogen, hydroxyl or other groups.

Specific, non-limiting, examples of suitable organoalkoxysilanes include the following:

phenylmethyldimethoxysilane
phenyltrimethoxysilane
diphenyldimethoxysilane
phenylmethyldiethoxysilane
trimethylmethoxysilane
vinylmethyldimethoxysilane
vinylphenyldimethoxysilane
allylmethyldimethoxysiane
N-methylaminopropylmethyldimethoxysilane
N-(3-methacryloxy-2-hydroxypropyl)-3-aminopropyltri-ethoxysilane
N-ethylaminoisobutyltri methoxysilane
3-(2,4-dinitrophenylamino)propyltriethoxysilane
N,N-dimethylaminopropyl)trimethoxysilane
(N,N-diethyl-3-aminopropyl)trimethoxysilane
N-butylaminopropyltrimethoxysilane
bis(2-hydroxyethyl)-3-aminopropyltriethoxysilane
3-aminopropyltris(methoxyethoxyethoxy)silane
3-aminopropyltrimethoxysilane
3-aminopropylmethyldiethoxysilane
3-aminopropyldimethylethoxysilane
p-aminophenyltrimethoxysilane
m-aminophenyltrimethoxysilane
3-(m-aminophenoxy)propyltrimethoxysilane
N-(2-aminoethyl)-11 -aminoundecyltrimethoxysilane
N-(6-aminohexyl)aminopropyltrimethoxysilane
N-(2-aminoethyl)-3-aminopropyltrimethoxysilane
N-(2-aminoethyl)-3-aminopropylmethyldimethoxysilane
N-(2-aminoethyl)-3-aminoisobutylmethyldimethoxysilane
3-(N-allylamino)propyltrimethoxysilane
[3-(triethoxysilylpropyl)-p-nitrobenzamide]
2-(diphenylphosphino)ethyltriethoxysilane
phenyloctyldialkoxysilane
dodecylmethyldialkoxysilane
n-octadecyldimethylmethoxysilane
n-decyltriethoxysilane
dodecylmethyldiethoxysilane
dodecyltriethoxysilane
hexadecyltrimethoxysilane
7-octenyltrimethoxysilane
2-(3-cyclohexenyl)ethyl]trimethoxysilane
(3-cyclopentadienylpropyl)triethoxysilane
21 -docosenyltriethoxysilane
(p-tolylethyl)methyldimethoxysilane
4-methylphenethylmethyldimethoxysilane
divinyldimethoxysilane
0-methyl(phenylethyl)trimethoxysilane
styrylethyltrimethoxysilane
(chloro p-tolyl)trimethoxysilane
p-(methylphenethyl)methyldimethoxysilane
[2-hydroxy-4-(3-triethoxysilylpropoxy)diphenylketone]
dimesityldimethoxysilane
di(p-tolyl))dimethoxysilane
(p-chloromethyl)phenyltrimethoxysilane
chlorophenylmethyldimethoxysilane
chlorophenyltriethoxysilane
phenethyltrimethoxysilane
phenethylmethyldimethoxysilane
N-phenylaminopropyltrimethoxysilane
3-cyanopropylmethyldimethoxysilane
2-cyanobutylmethyldimethoxysilane
3-cyanobutylmethyldimethoxysilane It is further contemplated herein that the dielectric enhancement fluid may comprise a mixture of two or more organoalkoxysilanes, such as a mixture of phenylmethyldimethoxysilane with trimethylmethoxysilane, as described in above cited U.S. Pat. No. 5,372,841. Preferably, the organoalkoxysilane is selected from tolylethymethyldimethoxysilane, a cyanopropylmethyldimethoxysilane, a cyanobutylmethyldimethoxysilane, phenylmethyldimethoxysilane, or phenyltrimethoxysilane.

The acid catalyst (b) to be included in the dielectric property-enhancing fluid composition of the instant method has a pKa less than about 2.1 and is added in an effective amount for promoting the hydrolysis reaction of the organoalkoxysilane with water and subsequent condensation of the resulting product of hydrolysis. For the purposes herein, pKa has its usual definition of the negative logarithm (base 10) of the equilibrium constant (Ka) for the dissociation of the acid. Preferably, the acid to be used in the instant method has a pKa value between about −14 and about 0. The optimum acid catalyst content may be determined experimentally using, e.g., the below described model cable tests. One skilled in the art will appreciate that it is desirable to employ an amount of acid catalyst which results in the retention of essentially all hydrolysis/condensation products in the model cable. However, this amount should be balanced by the cost of the catalyst. Moreover, the acid content should be kept as low as possible since it can contribute to the corrosion of the cable conductor, and this factor should be considered in the balance. Although it is recognized that the catalyst and the organoalkoxysilane interact on a molar basis, the acid catalyst (b)

should generally be added at a level of about 0.02 to about 1% based on the weight of the organoalkoxysilane (a) component. More typically, it should be supplied at a level of from about 0.05 wt. % to about 0.6 wt. %, preferably from about 0.06 wt. % to about 0.5 wt. %. Preferably, the acid catalyst (b) is selected from strong acids which essentially dissociates completely in an aqueous solution. For the purposes herein, preferred acids include methanesulfonic acid, trifluoromethanesulfonic acid, benzenesulfonic acid, sulfuric acid, nitric acid, trifluoracetic acid, dichloroacetic acid and phosphoric acid.

dimethyltinneodeconoate, di-N-octyltin-S,S-isooctylmercaptoacetate, dibutyltin-S,S-dimethylmercaptoacetate, and diethyltin-S,S-dibutylmercaptoacetate. This additional catalyst (c) is typically added at a level of about 0.03 to about 2% based on the weight of the organoalkoxysilane component. More typically, it should be supplied at a level of about 0.1 to about 1%, preferably about 0.2 to 0.6% by weight based on the content of organoalkoxysilane (a). Examples of specific dielectric property-enhancing fluid compositions containing an acid catalyst (b), an additional catalyst (c), and corrosion inhibitors are presented in Table 1, below

TABLE 1

| | Formulation weight % | | | | | |
|---|---|---|---|---|---|---|
| Component | 1 | 2 | 3 | 4 | 5 | 6 |
| Acetophenone | 18.985% | 15.402% | 12.368% | 9.343% | 5.309% | 2.284% |
| Propylene carbonate | 1.000% | 1.100% | 1.200% | 1.300% | 1.400% | 1.500% |
| tolylethylmethyl-dimethyloxysilane | 62.000% | 60.000% | 52.000% | 43.000% | 35.000% | 26.000% |
| 2-cyanobutyl-methyl-dimethoxysilane | 12.000% | 16.000% | 25.000% | 35.000% | 45.000% | 55.000% |
| Tinuvin ® 123 | 1.000% | 1.200% | 1.400% | 1.600% | 1.800% | 2.000% |
| Tinuvin ® 1130 | 1.000% | 1.200% | 1.400% | 1.600% | 1.800% | 2.000% |
| Geranyl acetone | 1.000% | 1.200% | 1.400% | 1.600% | 1.800% | 2.000% |
| IRGASTAB ® KV10 | 2.000% | 2.400% | 2.800% | 3.200% | 3.600% | 4.000% |
| Ferrocene | 0.500% | 1.000% | 2.000% | 3.000% | 4.000% | 5.000% |
| Trifluoromethane sulfonic acid | 0.161% | 0.156% | 0.135% | 0.112% | 0.091% | 0.068% |
| Tetraglyme | 0.229% | 0.222% | 0.192% | 0.159% | 0.130% | 0.096% |
| DBTDL | 0.124% | 0.120% | 0.104% | 0.086% | 0.070% | 0.052% |
| total | 100.000% | 100.000% | 100.000% | 100.000% | 100.000% | 100.000% |

Tinuvin ® 123 = Product of Ciba ®, CAS # 129757-67-1;
Tinuvin ® 1130 = Product of Ciba ® CAS # 104810-47-1
IRGASTAB ® KV10 = Product of Ciba ®, CAS # 110553-27-0;
DBTDL = dibutyltindilaurate.

As noted above, it is recognized that a composition containing a strong acid, such as methanesulfonic acid, tends to corrode the typical aluminum conductor of the cable and it should, therefore, also incorporate a corrosion inhibitor. Compounds which act as suitable corrosion inhibitors in such an environment may be exemplified by acetophenone, acetone, and Tinuvin® 123 product from Ciba® (CAS#: 129757-67-1). When such an inhibitor is employed, it is preferred to first mix the acid catalyst (b) with a polyether such as tetraglyme at a mole ratio of about 1:1 to form a complex and then to add this complex to the organoalkoxysilane (a) in an amount sufficient to provide the desired acid content in the final composition, as discussed above.

It is further contemplated herein that one or more hydrolysis/condensation catalyst (c), other than the above described acid catalyst (b), may be included in the dielectric property-enhancing fluid composition of the instant method. Such an additional catalyst may be selected from ones known to promote the hydrolysis and condensation of organoalkoxysilanes, provided it does not adversely affect the cable components. Typically, these are selected from organometallic compounds of tin, manganese, iron, cobalt, nickel, lead, titanium or zirconium. Examples of such additional catalysts (c) include alkyl titanates, acyl titanates and the corresponding zirconates. Specific non-limiting catalysts include dibutyltindiacetate (DBTDA), dibutyltindilaurate (DBTDL), tetraisopropyl titanate (TIPT), dibutyltindioctoate, stannous octoate, It is further contemplated that the above described cable restoration method, including any previously described variation thereof, can be practiced at elevated pressures, as taught in U.S.Patent Application Publication Nos. 2005/0192708 A1 and 2005/0189130 A1 using one of the high-pressure connectors described in U.S.Patent Application Publication Nos. 2005/0191910 A1, such as the swagable connector shown in FIG. 1. In brief, the high-pressure method comprises filling the interstitial void volume of the cable with at least one dielectric property-enhancing fluid composition, as described above, at a pressure below the elastic limit of the polymeric insulation jacket, and confining the dielectric property-enhancing fluid within the interstitial void volume at a residual pressure greater than about 50 psig, the pressure being imposed along the entire length of the cable and being below the elastic limit. As used herein, the term "elastic limit" of the insulation jacket of a cable is defined as the internal pressure in the interstitial void volume at which the outside diameter of the insulation jacket takes on a permanent set at 25° C. greater than 2% (i.e., the OD increases by a factor of 1.02 times its original value), excluding any expansion (swell) due to fluid dissolved in the cable components. This limit can, for example, be experimentally determined by pressurizing a sample of the cable with a fluid having a solubility of less than 0.1% by weight in the conductor shield and in the insulation jacket (e.g., water), for a period of about 24 hours, after first removing any covering such as insulation shield and wire wrap. Twenty-four hours after the pressure is released, the final OD is compared with the initial OD in making the above determination. Thus, another embodiment relates to a method for enhancing the dielectric properties of an electrical cable segment having a central stranded conductor encased in a polymeric insulation jacket and having an interstitial void volume in the region of the conductor, the method comprising:

(i) filling the interstitial void volume with at least one dielectric property-enhancing fluid composition at a pressure below the elastic limit of the polymeric insulation jacket; and (ii) confining the dielectric property-enhancing fluid composition within the interstitial void volume at a residual pressure greater than about 50 psig, the pressure being imposed along the entire length of the section and being below the elastic limit, wherein the composition comprises:

(a) an organoalkoxysilane; and (b) an acid catalyst having a $pK_A$ less than about 2.1

The actual pressure used to fill the interstitial void volume is not critical provided the above-defined elastic limit is not attained. After the desired amount of the fluid has been introduced, the fluid is confined within the interstitial void volume at a sustained residual pressure greater than about 50 psig. It is preferred that the residual pressure is between about 100 psig and about 1000 psig, most preferably between about 300 psig and 600 psig. Further, it is preferred that the injection pressure is at least as high as the residual pressure to provide an efficient fill of the cable (e.g., 550 psig injection and 500 psig residual). In another embodiment of this method, the residual pressure is sufficient to expand the interstitial void volume along the entire length of the cable section by at least 5%, again staying below the elastic limit of the polymeric insulation jacket. It is also contemplated that the dielectric property-enhancing fluid composition may be supplied at a pressure greater than about 50 psig for more than about 2 hours before being contained in the interstitial void volume. It is further preferred that the dielectric property-enhancing fluid composition is selected such that the residual pressure decays to essentially zero psig due to diffusion into the conductor shield and into the insulation jacket of the cable, as discussed in U.S. Patent Application Publication Nos. 2005/0192708 A1 and 2005/0189130 A1. This pressure decay generally occurs over a period of greater than about 2 hours, preferably in more than about 24 hours, and in most instances within about two years of containing the fluid composition. It is to be understood that this pressure decay results from diffusion of the various components of the fluid composition out of the interstitial volume and through the insulation jacket of the cable rather than by leaking past any terminal or splice connector.

A specific swagable high-pressure terminal connector of the type disclosed in Publication No. U.S. 2005/0191910, and use thereof to inject fluid into a cable, is described as follows. As shown in FIG. 1, the insulation jacket 12 of a cable 10 is received within a first end portion of a housing 130 of the connector 110. The first end portion of the housing 130 is sized such that its internal diameter (ID) is just slightly larger than the outer diameter (OD) of insulation jacket 12. As will be described in greater detail below, a swage is applied to the exterior of the first end portion of the housing 130 over an O-ring 134 which resides in an interior circumferentially-extending O-ring groove 135 in housing 130, multiple interior circumferentially-extending Acme thread-shaped grooves 138 in the housing, and an interior circumferentially-extending generally trapezoidal groove 136 in the housing. This insulation swaging region is shown in detail in the DETAIL A of FIG. 1 and enlarged in FIG. 2.

Figure 2:
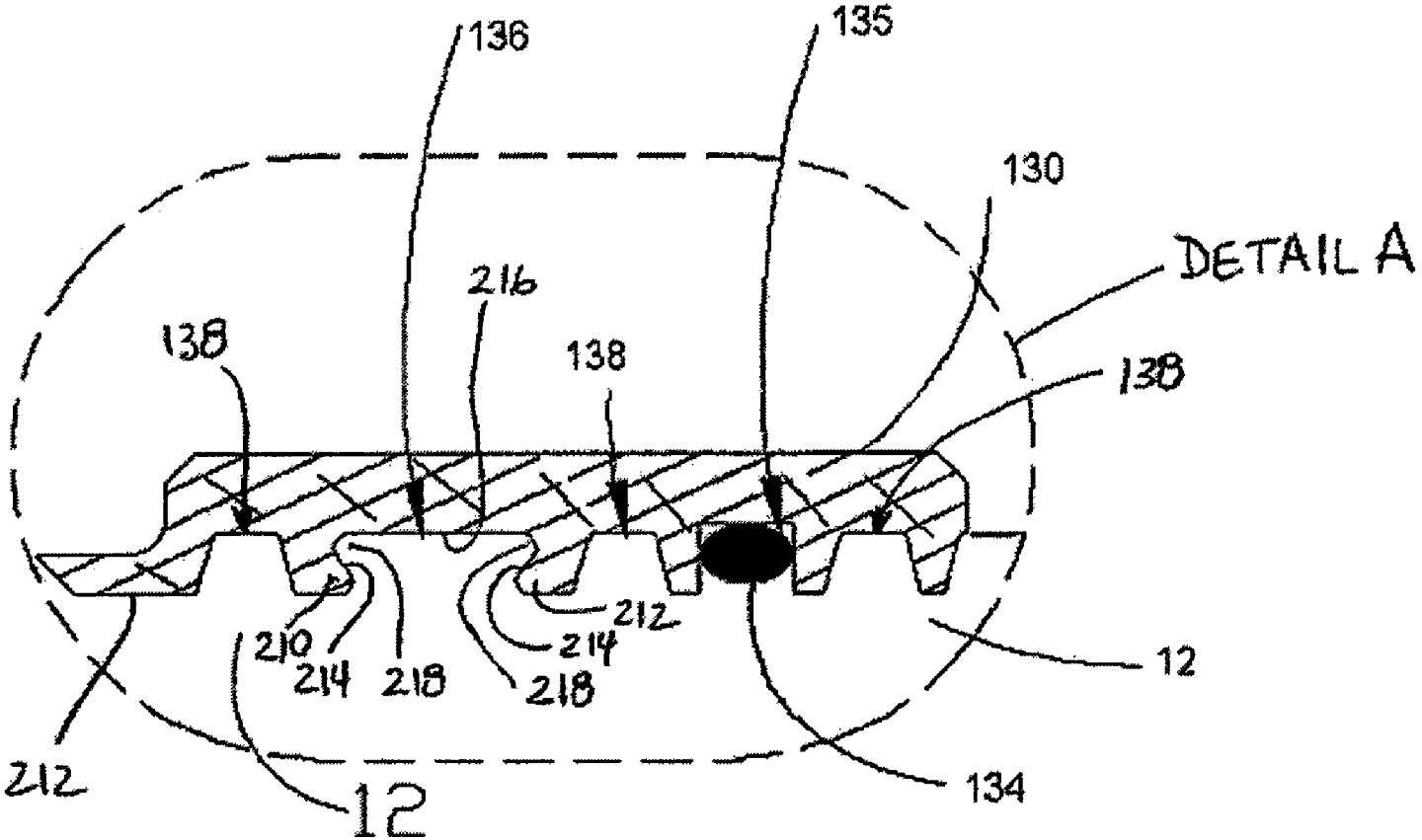
FIG. 2 is a cross-sectional view of detail area A of FIG. 1 showing the swaging region over the insulation jacket.

Referring to FIGS. 1 and 2, the trapezoidal groove 136 has a pair of oppositely-oriented, axially-projecting circumferentially-extending spurs 210 and 212. The spurs 210 and 212 are disposed essentially at an interior wall of the housing 130, and project in opposite axial directions toward each other. The spurs 210 and 212 are provided by forming the circumferential groove 136 in the interior wall of the housing 130 at an axial position along the first end portion of the housing within the above described insulation swaging region over the insulation jacket (i.e., within an engagement portion of the housing). The circumferential groove 136 and the spurs 210 and 212, extend completely around the inner circumference of the inner wall of the housing 130. Each spur 210 and 212 has a generally radially outward facing wall 214 spaced radially inward from a radially inward facing recessed wall portion 216 of the housing 130 located within the groove. A pair of circumferentially-extending recesses 218 within the groove 136 are defined between the radially outward facing walls 214 of the spurs 210 and 212 and the radially inward facing recessed wall portion 216 of the housing 130. The recesses 218 form axially-opening undercut spaces located radially outward of the spurs within which a portion of the insulation jacket 12 of the cable 10 is pressed and at least partially flows as a result of the swage applied to the exterior of the first end portion of the housing 130 in the insulation swaging region described above. This operation forces at least some polymer of the insulation jacket 12 into the groove 136 and further into the recesses 218 (i.e., into the undercuts). Thus, after swaging in the insulation swaging region, the polymer of the insulation jacket 12 within the groove 136 and the groove itself form an interlocking joint, much like a dovetail mortise and tenon joint or union. As a result, a fluid-tight seal is formed between the insulation jacket 12 and the housing 130, which not only prevents pushback of the insulation jacket, but also provides leak-free operation when the cable contains fluid at elevated pressure and is subjected to substantial thermal cycling that otherwise might cause relative radial movement and separation of the insulation jacket and the housing, and hence fluid leakage during the cooling phase of a thermal cycle. For the purposes herein, "substantial thermal cycling" refers to thermal cycling wherein the mode (i.e., peak) of the distribution with respect to time of $\Delta T$, the difference between the high and low conductor temperatures, is at least about 20° C. FIG. 1 shows a partial cross-sectional view of an injection tool 139 clamped in position over the swagable high-pressure terminal connector 110 just prior to injection of dielectric enhancement fluid into the cable 10, as further described below.

In a typical assembly procedure using this embodiment, the insulation jacket 12 of cable 10 is first prepared for accepting a termination crimp connector 131, as described in Publication No. US 2005/0191910. The housing 130 of the connector 110 includes an injection port 48 (see detail B, FIG. 3). As described above, the housing is sized such that its larger internal diameter (ID) at the first end portion of the housing 130 is just slightly larger than the outer diameter (OD) of insulation jacket 12 and its smaller ID at an opposite second end portion is just slightly larger than the OD of a termination crimp connector 131. The housing 130 is slid over the conductor 14 of the cable 10 and over the insulation jacket 12 of the cable, and the termination crimp connector 131 is then slipped over the end of the conductor 14 and within the housing. The second end portion of the housing 130, having first O-ring 104 residing in a groove therein, is first swaged with respect to termination crimp connector 131. This first swage is applied over the first O-ring 104 and the essentially square machined interior teeth 108 of the second end of the housing 130. Swaging can be performed in a single operation to produce swaging together of the conductor 14 and the termination crimp connector 131, and swaging together of the housing 130 and the termination crimp connector 131. Alternatively, swaging can be performed in phases wherein the termination crimp connector 131 is swaged together with conductor 14 before the housing 130 is swaged together with the resulting termination crimp connector/conductor combination. This swaging operation joins the conductor 14, the termination crimp connector 131, and the housing 130 in intimate mechanical, thermal and electrical union and provides a redundant seal to the O-ring 104 to give a fluid-tight seal between the housing 130 and the termination crimp connector 131. In FIG. 1, a copper termination lug 133 is spin welded to the aluminum termination crimp connector 131 to provide a typical electrical connection. The swaged assembly is then (optionally) twisted to straighten the lay of the outer strands of the conductor 14 to facilitate fluid flow into and out of the strand interstices. A second swage is then applied to the exterior of the first end portion of the housing 130 over the second O-ring 134 (which resides in the separate interior groove 135 in the housing 130), the Acme thread-shaped grooves 138, and the trapezoidal groove 136 (i.e., over the insulation swaging region of DETAIL A of FIG. 1 and enlarged in FIG. 2). O-rings 104 and 134 can be fabricated from ethylene-propylene rubber (EPR), ethylene-propylene diene monomer (EPDM) rubber or, preferably, a fluoroelastomer such as Viton® while housing 130 is preferably made of stainless steel. This second swaging operation forces at least some polymer of insulation jacket 12 into the trapezoidal groove 136 and the Acme thread grooves 138, while simultaneously deforming O-ring 134 to the approximate shape depicted in FIG. 2. As a result, a fluid-tight seal is formed between insulation jacket 12 and the first end portion of the housing 130, which seal prevents pushback of the insulation and provides leak-free operation when the cable 10 contains fluid at elevated pressure and is subjected to substantial thermal cycling as described above. It is also possible to perform the swaging operation over the insulation before swaging over the conductor, but the above sequence is preferred. At this point, the swaged connector 110, and cable 10 to which it is attached, is ready to be injected with a dielectric enhancement fluid at an elevated pressure.

Figure 3:
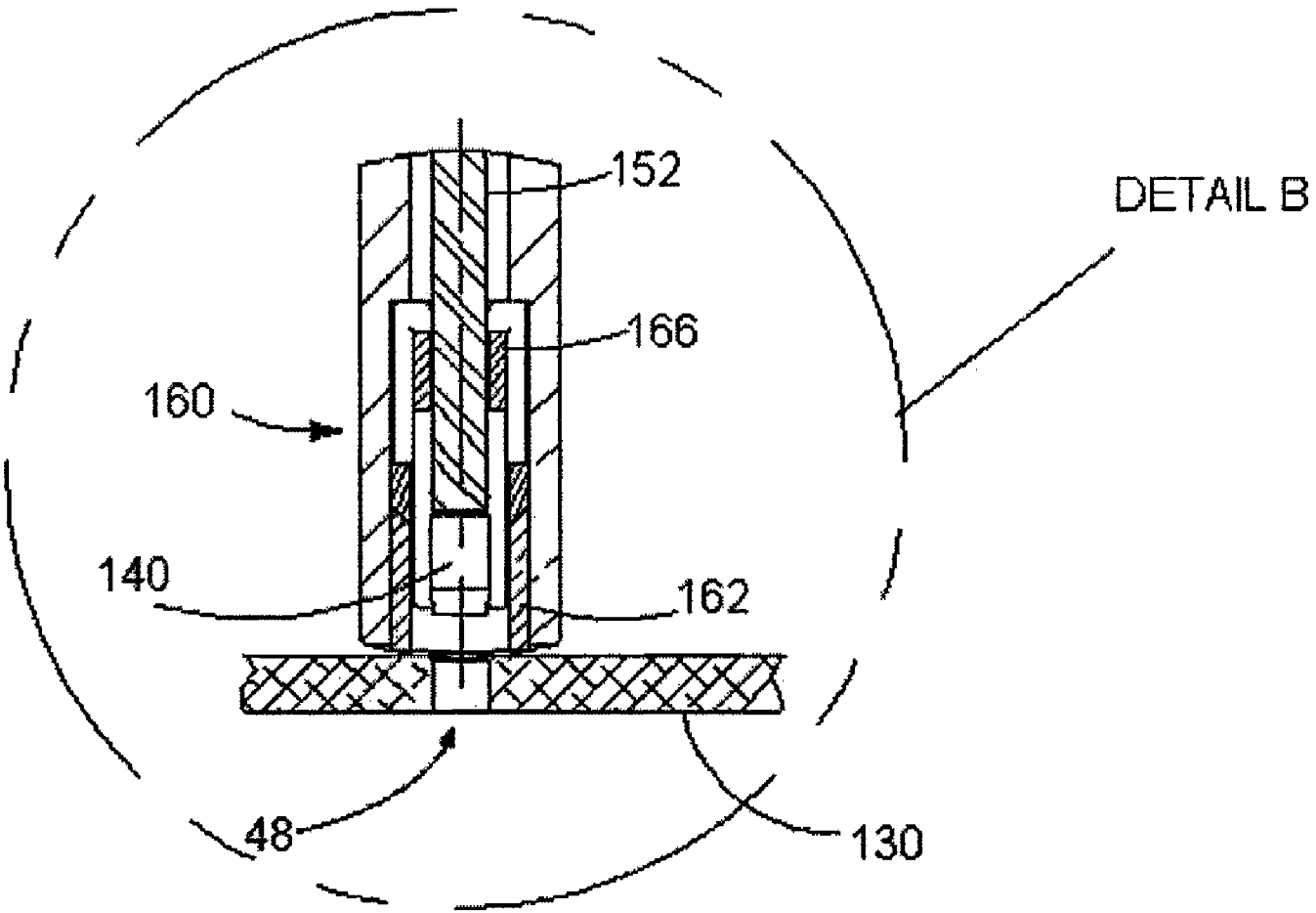
FIG. 3 is a cross-sectional view of detail area B of FIG. 1 showing the seal tube and injector tip.

In a typical injection procedure, a plug pin 140, further described below, is loaded into a seal tube injector tip 160 of injection tool 139 such that it is held in place by spring collet 166, as shown in FIG. 3. Spring collet 166 comprises a partially cutout cylinder that has two 180° opposing "fingers" (not shown) which grip plug pin 140 with sufficient force such that the latter is not dislodged by handling or fluid flow, but can be dislodged when the plug pin 140 is inserted into injection port 48. The fluid to be injected, as further described below, can flow between these "fingers" of spring collet 166. Referring to FIGS. 1 and 3, yoke 148 is positioned over housing 130 and its center line is aligned with injection port 48 using a precision alignment pin (not shown), the latter being threaded into yoke 148. The precision alignment pin (not shown) brings the axis of clamp knob 150 and injection port 48 into precise alignment. Clamp chain 142, attached at one side to yoke 148, is wrapped around housing 130 and then again attached to a hook on the other side of yoke 148. The now loosely attached chain is tightened by turning clamp knob 150 (by means of threads-not shown). The precision alignment pin is unthreaded and removed from the yoke 148. Injection tool 139 is threaded into the yoke 148 and seal knob 146 is then threaded into clamp knob 150 to compress a polymeric seal 162 against the exterior of housing 130, the entire injection tool 139 now being in precise alignment with injection port 48. At this point there is a fluid-tight seal between the seal tube injector tip 160 and the housing 130, thereby providing a flow path (for fluid) through injection port 48 between the interior of the injection tool 139 and the interior of the housing 130, as shown in FIG. 3.

Figure 4:
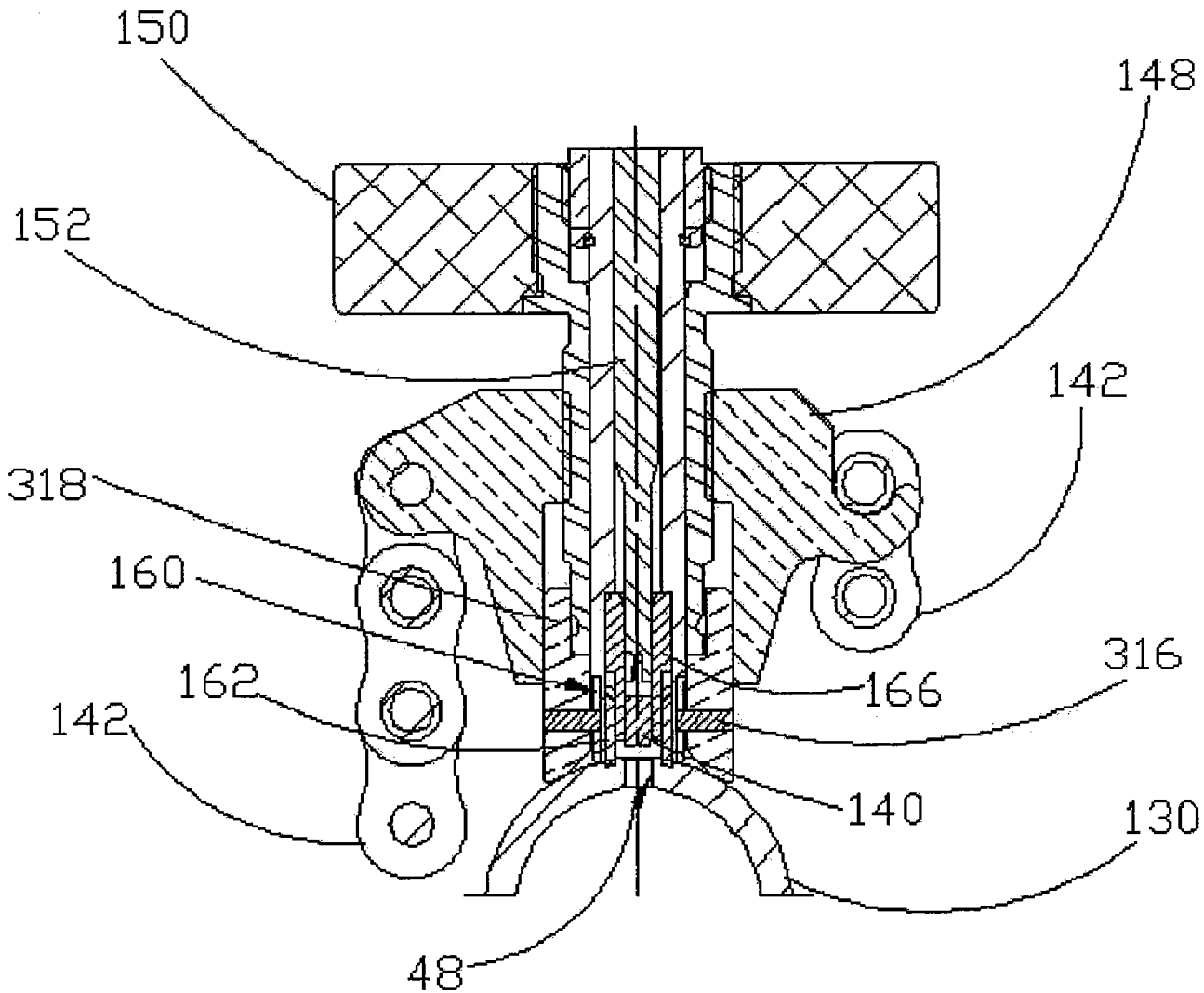
FIG. 4 is an enlarged cross-sectional view of the lower portion of the injection tool shown in FIG. 1 taken along the axial direction of the injection tool.
Figure 5:
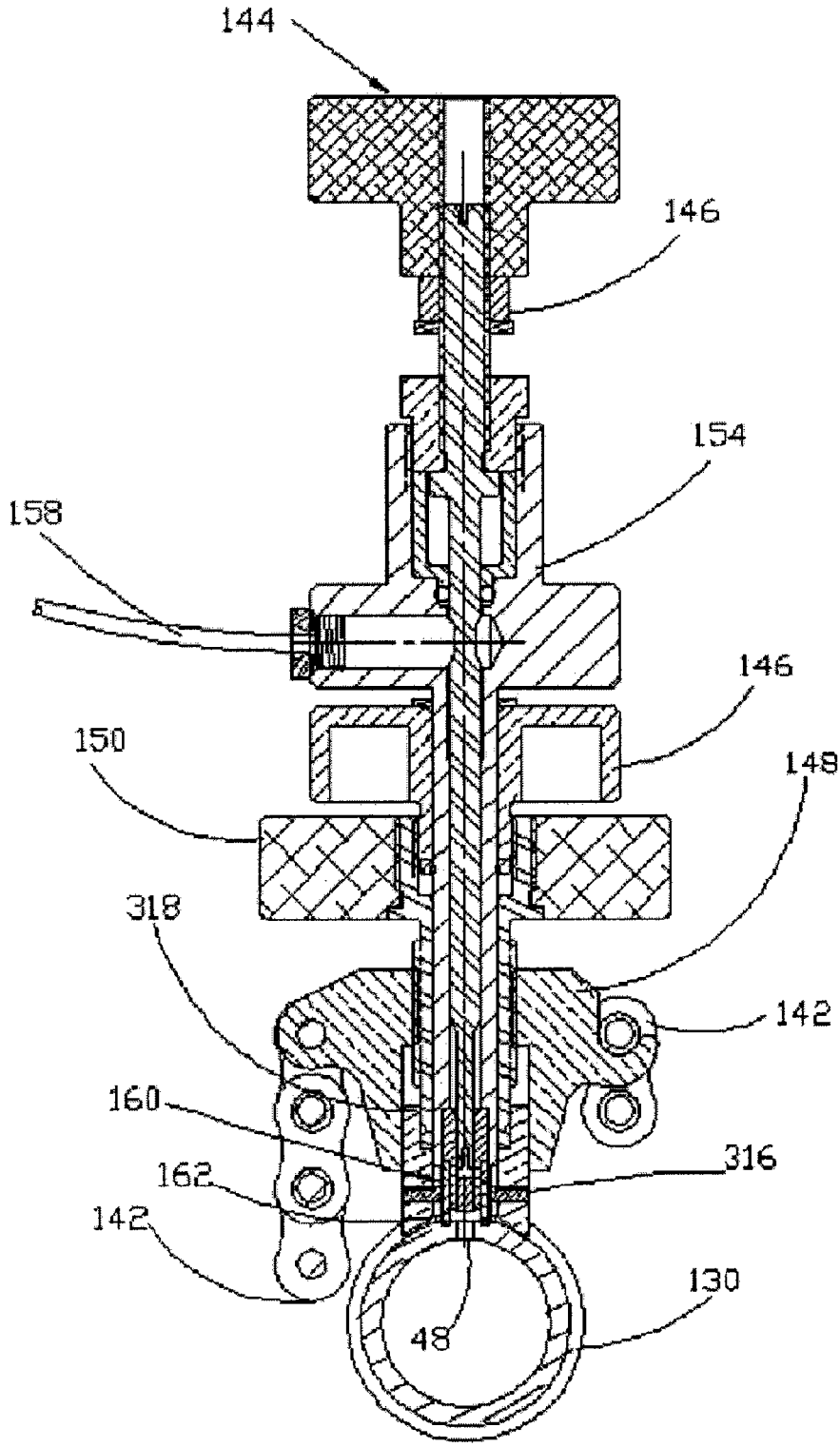
FIG. 5 is an enlarged cross-sectional view of the injection tool shown in FIG. 1 taken along the axial direction of the injection tool.
Figure 6:
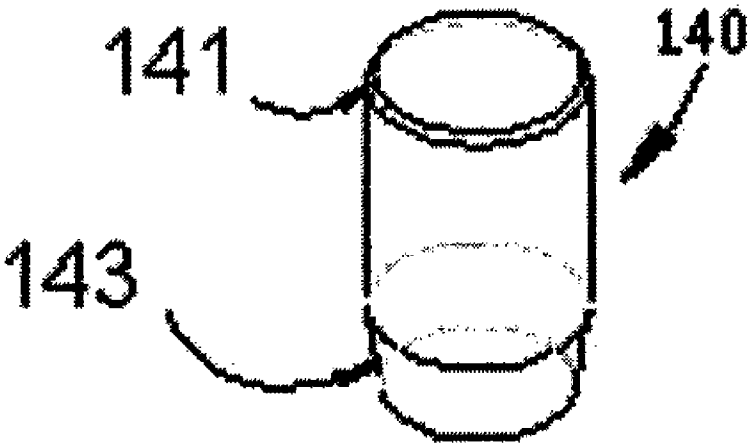
FIG. 6 is a perspective view of a plug pin used to seal the injection port of the connector shown in FIG. 1.

FIGS. 4 and 5 show an enlarged cross-sectional view of the injection tool 139 in a direction along the axial direction of the injection tool. These figures show slide block 318 which presses against the housing 130 with a force equal to twice the tension of chain 142. Guide pins 316 align with slots in the seal tube injector tip 160 and orient it with respect to housing 130 such that the axes of their respective curvatures are aligned, thus allowing a fluid tight seal to be made. Pressurized fluid is then introduced to the interior of connector 110 and the interstitial void volume of cable 10 via a tube 158, seal tube inlet 154 and an annulus (not shown) formed between the seal tube injector tip 160 and the assembly of a press pin 152 and the plug pin 140. After the predetermined amount of fluid has been introduced (or a predetermined uniform pressure along the full length of the cable has been attained, as described in detail in above cited Publication No. US 2005/0191910), a press pin actuator knob 144 is tightened (utilizing mated threads in the injection tool 139—not shown) so as to advance press pin 152 toward injection port 48, thereby pushing plug pin 140 into injection port 48 such that the nominally circular end surface of plug pin 140, located adjacent to a first chamfered end 141 of the plug pin, is essentially flush with the exterior surface of the housing 130. The first chamfered end 141 of the plug pin 140, illustrated in perspective view in FIG. 6, assures a post injection "no snag" exterior surface for the finished assembly of housing 130. The plug pin 140 has as a diameter slightly larger than the diameter of injection port 48 to provide a force fit therein. Finally, plug pin 140 also has a second chamfered end 143 to allow self-guidance into injection port 48 and to allow the force fit with injection port 48 to create a fluid-tight seal. At this point, the pressurized fluid supply is discontinued and injection tool 139 is disconnected from connector 110 to complete the injection process. Plug pin 140 can subsequently be pushed into the interior of the connector 110 in the event that additional fluid is to be injected or the system needs to be bled for any reason, and later a slightly larger plug pin can be re-inserted.

EXAMPLES

Figure 7:
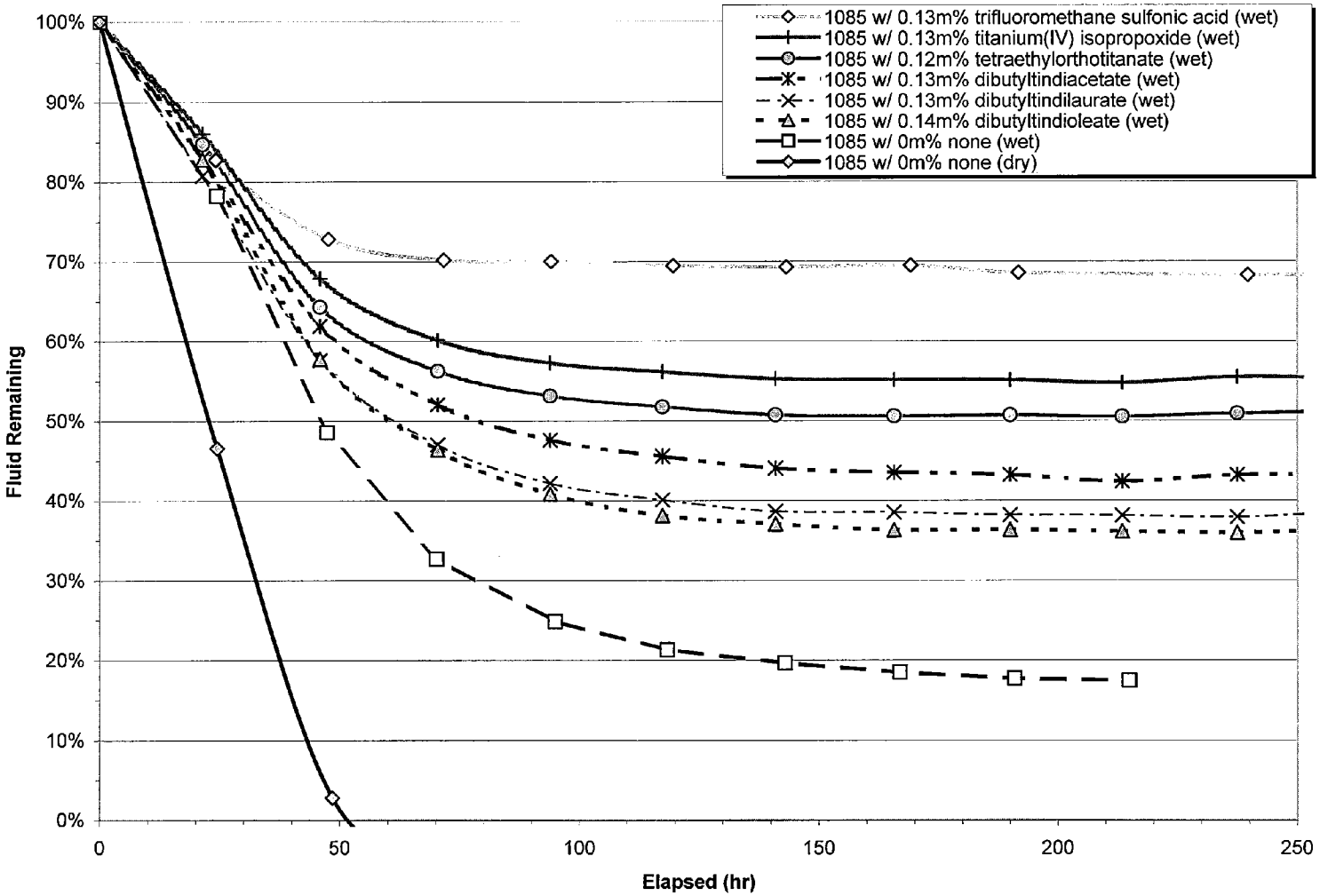
FIG. 7 is a plot of the fluid retention % as a function of time for experimental model cables immersed in water at 55° C., the model cable containing compositions comprising tolylethylmethyl-dimethoxysilane and various catalysts.

An approximately 12 inch-long polyethylene (LDPE) tube having an inner diameter (ID) of about 1/16 inch and an outer diameter (OD) of about 1/8 inch was sealed at one end by melting the end shut with a soldering iron. The tube was weighed and an approximately 11.5 inch-long aluminum wire having a diameter of about 0.0508 inch was weighed and inserted into the tube. This combination has approximately the same relative geometry as a typical AWG 1/0, 15 kV, 100% insulation cable with respect to the ratio of interstitial volume to polyethylene volume and is therefore a good surrogate for the latter; it is referred to as a "model cable" herein. Further, it should be noted that the XLPE (crosslinked polyethylene) generally used in cables is LDPE (low density polyethylene) and it is known that there is little difference between the permeation properties of these two polymers. A numbered rectangular aluminum identification tag was weighed and the tube/wire combination was inserted through one of two holes in the tags. The tube, wire and identification tag were again weighed as an assembly. A fluid composition (i.e., either a tolylethylmethyldimethyloxysilane control fluid, or a tolylethylmethyldimethyloxysilane composition containing about 0.13 mole % of a catalyst, as further described below) was injected into the open end of the tube with the aid of a hypodermic syringe. The assembly was again weighed to provide the weight of the fluid in the wire/tube. The open end of the tube was inserted through the second hole in the tag and melted shut, as described above, and the assembly was again weighed to provide a final amount of the fluid sealed within the tube. Three such wire/tube assemblies were prepared for each of the fluid compositions tested below and these were then placed into a water bath held at 55° C. Periodically, each assembly was removed from the water bath, blotted dry and weighed at room temperature to calculate the amount of fluid composition (as a percentage of initial fluid weight) remaining in the tube (i.e., the initial tolylethylmethyldimethyloxysilane plus any hydrolysis/condensation products thereof that did not diffuse out of the tube). Typical results of the percent fluid remaining in the tube as a function of time are shown in FIG. 7 for various fluids, each point representing an average of these measurements. From FIG. 7, it can be seen that, as expected, the control fluid (tolylethylmethyldimethoxysilane without a catalyst; represented by □) continued to exude fluid (e.g., below about 20% retention) since condensation was largely precluded. To the contrary, when a catalyst such as tetraisopropyltitanate (TIPT) was added to the tolylethylmethyldimethoxysilane at a mole % of 0.13 (represented by +) the retained fluid weight leveled off after about 100 hours at about 52% and thus exhibited a "retention plateau." This retention plateau value was estimated as the mean value of all measured data between about 140 and 400 elapsed hours. Similarly, tolylethylmethyldimethoxysilane was combined with several other organometallic catalysts, as well as one acid catalyst, also at about 0.13 mole percent, and the average fluid retention of these compositions as a function of time are also shown in FIG. 7. In this figure, the following notation is used to identify the various catalysts tested:

| Symbol | Catalyst |
|---|---|
| ◇ | trifluoromethanesulfonic acid |
| + | tetraisopropyltitanate (TIPT) |
| ⊗ | tetraethylorthotitanate (0.12 mole %) |
| ★ | dibutyltindiacetate |
| X | dibutyltindilaurate |
| △ | dibutyltindioleate (0.14 mole %) |
| □ | none (control in water at 55° C.) |
| ◈ | none (samples held at 55° C. in dry oven) |

It can be seen that the strong acid catalyst, trifluoromethanesulfonic acid, (represented by ◇) resulted in a considerably greater retention plateau value than any of the organometallic catalysts of FIG. 7. Furthermore, it should be understood that each gram of the tolylethylmethyldimethoxysilane initially introduced to a model cable at most results in only about 0.79 gram of oligomeric species due to hydrolysis/condensation and subsequent exudation of the methanol generated. Thus, the fluid retention values reported herein should be divided by about 0.79 to arrive at the theoretically possible retention percentage of a given hydrolyzate having no silanol or methoxy groups. For example, an experimental retention plateau of 55% would correspond to 55/0.79, or about 70% retention of hydrolyzate based on the theoretical maximum.

Other acid catalysts were evaluated according to the above procedure, again at a level of about 0.13 mole %, and the respective average retention plateau values are presented in Table 2.

TABLE 2

| Acid Catalyst | pKa | Retention Plateau in Composition of Tolylethylmethyldimethyloxysilane + 0.13 mole % Acid Catalyst |
|---|---|---|
| trifluoromethanesulfonic acid | −14.00 | 75.3% |
| sulfuric acid | −4.00 | 75.7% |
| benzenesulfonic acid | −2.65 | 77.5% |
| methanesulfonic acid | −1.65 | 75.9% |
| nitric acid | −1.29 | 68.4% |
| trifluoroacetic acid | −0.07 | 69.6% |
| dichloroacetic acid | 1.39 | 71.1% |
| phosphoric acid | 2.06 | 62.3% |
| acetic acid | 4.76 | 14.3% |
| acetic acid | 4.76 | 11.8% |
| Water | 15.74 | 13.6% |

Figure 8:
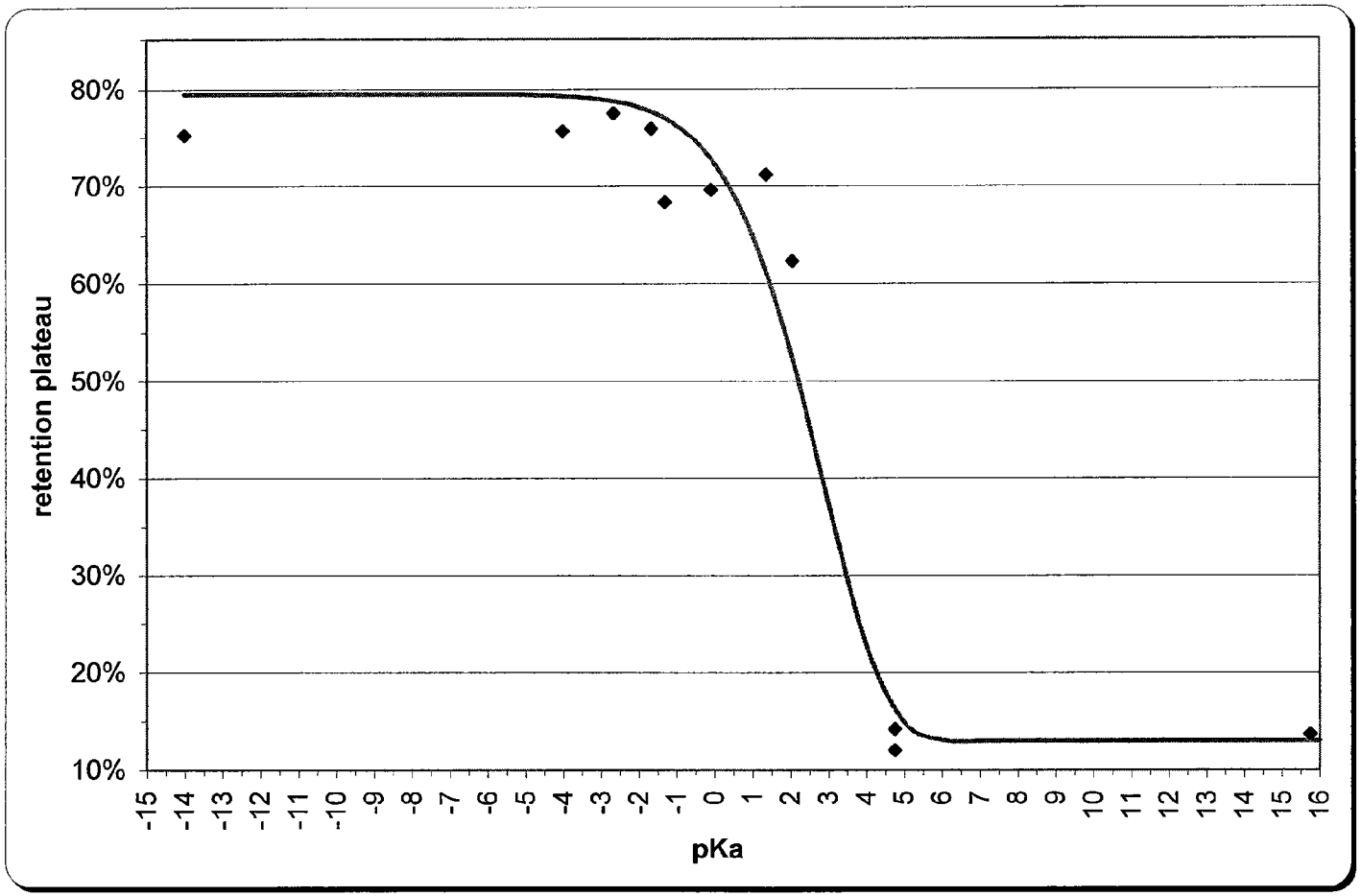
FIG. 8 is a plot of the fluid retention plateau % as a function of acid catalyst pKa for tolylethylmethyldimethoxysilane compositions catalyzed with various acids in experimental model cables immersed in water at 55° C.

It can be seen that the retention plateau is significantly greater for catalysts having a pKa less than about 2.1. This observation is graphically illustrated in FIG. 8, wherein the retention plateau % is plotted against acid pKa.

Figure 9:
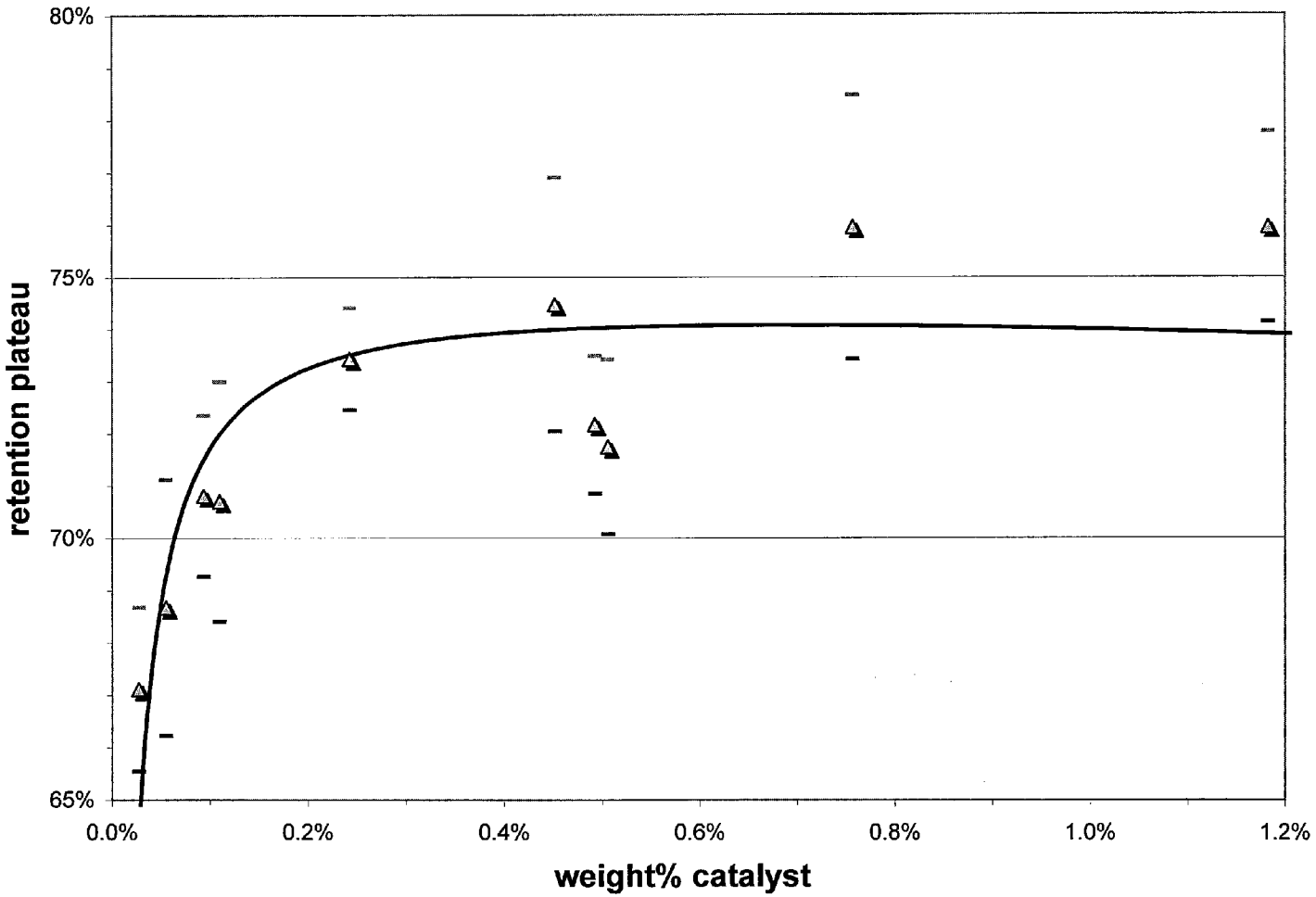
FIG. 9 is a plot of the fluid retention plateau % as a function of weight % of methanesulfonic acid used to catalyze tolylethylmethyldimethoxysilane in experimental model cables immersed in water at 55° C.

Finally, the above model cable experiments were used to determine the effect of the concentration of methanesulfonic acid (MSA) in tolylethylmethyldimethoxysilane on the retention plateau value, this relationship being illustrated in FIG. 9, wherein the curve is a least-squares fit of the points. This plot illustrates the above admonition that little is gained by adding such a strong acid catalyst at levels beyond, e.g., about 0.2 to 0.4 weight %.

That which is claimed is:

1. A method for enhancing the dielectric properties of an electrical cable having a central stranded conductor encased in a polymeric insulation and having an interstitial void volume in the region of the conductor, the method comprising at least partially filling the interstitial void volume with a dielectric enhancement fluid composition comprising (a) at least one organoalkoxysilane; and (b) an acid catalyst having a $pK_A$ less than about 2.1.

2. The method according to claim 1, wherein said dielectric enhancement fluid composition further comprises (c) an organometallic catalyst.

3. The method according to claim 2, wherein said organometallic catalyst is selected from dibutyltindiacetate, dibutyltindilaurate, tetraisopropyl titanate, dibutyltindioctoate, stannous octoate, or dimethyltinneodeconoate.

4. The method according to claim 3, wherein said organoalkoxysilane is represented by the formula:

$$(RO)_xSiR'_yR''_zR'''_{(4-x-y-z)}$$

where R denotes an alkyl group having 1 to 12 carbon atoms, R', R'', and R''' independently denote groups selected from substituted or unsubstituted aliphatic, unsaturated aliphatic or aromatic groups having up to 12 carbon atoms, x is an integer having a value of 1 to 3, and y and z are integers each having a value of 0 to 3.

5. The method according to claim 3, wherein said organoalkoxysilane is selected from (p-tolylethyl)methyldimethoxysilane, phenylmethyldimethoxysilane, phenyltrimethoxysilane, 3-cyanopropylmethyldimethoxysilane, 3-cyanobutyl-methyldimethoxysilane, or 2-cyanobutylmethyldimethoxysilane, and said acid catalyst is selected from methanesulfonic acid, trifluoromethanesulfonic acid, benzenesulfonic acid, sulfuric acid, nitric acid, trifluoracetic acid, dichioroacetic acid, or phosphoric acid.

6. The method according to claim 1, wherein said acid catalyst is selected from methanesulfonic acid, trifluoromethanesulfonic acid, benzenesulfonic acid, sulfuric acid, nitric acid, trifluoracetic acid, dichloroacetic acid or phosphoric acid.

7. The method according to claim 1, wherein said organoalkoxysilane is represented by the formula:

$$(RO)_xSiR'_yR''_zR'''_{(4-x-y-z)}$$

where R denotes an alkyl group having 1 to 12 carbon atoms, R', R", and R'"independently denote groups selected from substituted or unsubstituted aliphatic, unsaturated aliphatic or aromatic groups having up to 12 carbon atoms, x is an integer having a value of 1 to 3, and y and z are integers each having a value of 0 to 3.

8. The method according to claim 7, wherein R is a methyl group, x is 2 or 3 and at least one other substituent on the silicon atom is selected from an aromatic group or unsaturated aliphatic group.

9. The method according to claim 1, wherein said organoalkoxysilane is selected from (p-tolylethyl)methyldimethoxysilane, phenylmethyldimethoxysilane, phenyltrimethoxysilane, 3-cyanopropylmethyldimethoxysilane, 3-cyanobutyl-methyldimethoxysilane, or 2-cyanobutylmethyldimethoxysilane, and said acid catalyst is selected from methanesulfonic acid, trifluoromethanesulfonic acid, benzenesulfonic acid, sulfuric acid, nitric acid, trifluoracetic acid, dichloroacetic acid, or phosphoric acid.

10. A method for enhancing the dielectric properties of an electrical cable segment having a central stranded conductor encased in a polymeric insulation jacket and having an interstitial void volume in the region of the conductor, the method comprising:

(i) substantially filling the interstitial void volume with at least one dielectric property-enhancing fluid composition at a pressure below the elastic limit of the polymeric insulation jacket; and (ii) confining the dielectric property-enhancing fluid composition within the interstitial void volume at a residual pressure greater than about 50 psig, the pressure being imposed along the entire length of the section and being below the elastic limit, wherein the composition comprises:

(a) at least one organoalkoxysilane; and (b) an acid catalyst having a $pK_A$ less than about 2.1.

11. The method according to claim 10, wherein said dielectric property-enhancing fluid composition further comprises (c) an organometallic catalyst.

12. The method according to claim 11, wherein said organometallic catalyst is selected from dibutyltindiacetate, dibutyltindilaurate, tetraisopropyl titanate, dibutyltindioctoate, stannous octoate, or dimethyltinneodeconoate.

13. The method according to claim 12, wherein organoalkoxysilane is represented by the formula:

$$(RO)_xSiR'_yR''_zR'''_{(4-x-y-z)}$$

where R denotes an alkyl group having 1 to 12 carbon atoms, R', R", and R'"independently denote groups selected from substituted or unsubstituted aliphatic, unsaturated aliphatic or aromatic groups having up to 12 carbon atoms, x is an integer having a value of 1 to 3, and y and z are integers each having a value of 0 to 3.

14. The method according to claim 12, wherein said organoalkoxysilane is selected from (p-tolylethyl)methyldimethoxysilane, phenylmethyldimethoxysilane, phenyltrimethoxysilane, 3-cyanopropylmethyldimethoxysilane, 3-cyanobutyl-methyldimethoxysilane, or 2-cyanobutylmethyldimethoxysilane, and said acid catalyst is selected from methanesulfonic acid, trifluoromethanesulfonic acid, benzenesulfonic acid, sulfuric acid, nitric acid, trifluoracetic acid, dichloroacetic acid, or phosphoric acid.

15. The method according to claim 10, wherein said acid catalyst is selected from methanesulfonic acid, trifluoromethanesulfonic acid, benzenesulfonic acid, sulfuric acid, nitric acid, trifluoracetic acid, dichloroacetic acid or phosphoric acid.

16. The method according to claim 10, wherein said organoalkoxysilane is represented by the formula:

$$(RO)_xSiR'_yR''_zR'''_{(4-x-y-z)}$$

where R denotes an alkyl group having 1 to 12 carbon atoms, R', R", and R'"independently denote groups selected from substituted or unsubstituted aliphatic, unsaturated aliphatic or aromatic groups having up to 12 carbon atoms, x is an integer having a value of 1 to 3, and y and z are integers each having a value of 0 to 3.

17. The method according to claim 16, wherein R is a methyl group, x is 2 or 3 and at least one other substituent on the silicon atom is selected from an aromatic group or an unsaturated aliphatic group.

18. The method according to claim 10, wherein said organoalkoxysilane is selected from (p-tolylethyl)methyldimethoxysilane, phenylmethyldimethoxysilane, phenyltrimethoxysilane, 3-cyanopropylmethyldimethoxysilane, 3-cyanobutyl-methyldimethoxysilane, or 2-cyanobutylmethyldimethoxysilane, and said acid catalyst is selected from methanesulfonic acid, trifluoromethanesulfonic acid, benzenesulfonic acid, sulfuric acid, nitric acid, trifluoracetic acid, dichioroacetic acid, or phosphoric acid.

19. The method according to claim 10, wherein said dielectric property-enhancing fluid composition is supplied at a pressure greater than about 50 psig before being confined in the interstitial void volume.

20. The method according to claim 10, wherein the dielectric property-enhancing fluid composition is selected such that the residual pressure decays to essentially zero psig over a period greater than about 2 hours.

21. The method according to claim 10, wherein the pressure during said filling step (i) is at least between about 100 psig and about 1000 psig and said residual pressure of step (ii) is between about 100 psig and about 1000 psig.

22. The method according to claim 21, wherein said organoalkoxysilane is selected from (p-tolylethyl)methyldimethoxysilane, phenylmethyldimethoxysilane, phenyltrimethoxysilane, 3-cyanopropylmethyldimethoxy-silane, 3-cyanobutyl-methyldimethoxysilane, or 2-cyanobutylmethyldimethoxysilane, and said acid catalyst is selected from methanesulfonic acid, trifluoromethanesulfonic acid, benzenesulfonic acid, sulfuric acid, nitric acid, trifluoracetic acid, dichloroacetic acid, or phosphoric acid.

* * * * *